US011635723B2

(12) United States Patent
Thanh

(10) Patent No.: US 11,635,723 B2
(45) Date of Patent: Apr. 25, 2023

(54) IMAGE FORMING APPARATUS INCLUDING A ROTATABLE MANUAL FEED TRAY

(71) Applicant: KYOCERA Document Solutions Inc., Osaka (JP)

(72) Inventor: Bui Chi Thanh, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/687,872

(22) Filed: Mar. 7, 2022

(65) Prior Publication Data

US 2022/0291625 A1 Sep. 15, 2022

(30) Foreign Application Priority Data

Mar. 15, 2021 (JP) ..... JP2021-041147

(51) Int. Cl.
*G03G 15/00* (2006.01)
*G03G 21/16* (2006.01)

(52) U.S. Cl.
CPC ..... *G03G 15/6514* (2013.01); *G03G 21/1633* (2013.01); *G03G 2215/00392* (2013.01)

(58) Field of Classification Search
CPC ..... G03G 15/6514; G03G 2215/00392; B65H 2407/21; B65H 2601/325
USPC ..... 399/392; 271/9.09
See application file for complete search history.

(56) References Cited

U.S. PATENT DOCUMENTS

2009/0267283 A1* 10/2009 Mizuguchi ..... G03G 15/6514 271/3.14
2017/0349389 A1* 12/2017 Nishiyama ..... B65H 1/266
2019/0146398 A1* 5/2019 Maeda ..... B65H 1/04 271/8.1
2020/0010291 A1* 1/2020 Shibayama ..... B65H 1/04
2020/0017321 A1* 1/2020 Ohtsuka ..... G03G 15/6529

FOREIGN PATENT DOCUMENTS

JP 2019-089635 6/2019

* cited by examiner

*Primary Examiner* — Robert B Beatty
(74) *Attorney, Agent, or Firm* — Lex IP Meister, PLLC

(57) ABSTRACT

The image forming apparatus includes a side panel and a manual feed tray that is rotatable and installed on the side panel. The side panel includes an opening portion through which a sheet placed on the manual feed tray passes when the sheet is fed into the image forming apparatus. The manual feed tray includes an end cursor that is movable, and a guide portion that guides movement of the end cursor in a direction perpendicular to a rotational center of the manual feed tray. The opening portion is sized to accommodate the end cursor. When the opening/closing angle of the manual feed tray with respect to a horizontal direction exceeds a predetermined angle, the end cursor moves along the guide portion by gravity to a position where the end cursor can be accommodated in the opening portion.

1 Claim, 6 Drawing Sheets

IMAGE FORMING APPARATUS INCLUDING A ROTATABLE MANUAL FEED TRAY

INCORPORATION BY REFERENCE

This application is based upon and claims the benefit of priority from the corresponding Japanese Patent Application No. 2021-041147 filed on Mar. 15, 2021, the entire contents of which are incorporated herein by reference.

BACKGROUND

The present disclosure relates to an image forming apparatus.

A typical image forming apparatus includes a manual feed tray rotatable on a side surface of the image forming apparatus. When the manual feed tray is in an open state, a print sheet can be placed thereon, and when the manual feed tray is in a closed state, the print sheet is accommodated on the side surface of the image forming apparatus. The print sheet placed on the manual feed tray is fed into the apparatus through an opening formed on the side surface of the image forming apparatus.

In the typical image forming apparatus described above, the manual feed tray is accommodated in the side surface of the image forming apparatus, but when the manual feed tray includes an end cursor capable of moving, in order to prevent the end cursor from interfering with the side surface of the image forming apparatus and preventing the manual feed tray from being accommodated, it is necessary for the user to move the end cursor to a position corresponding to the opening described above and then to rotate the manual feed tray and accommodate the end cursor in the side surface of the image forming apparatus. Therefore, it takes time to accommodate the manual feed tray, and the user's convenience is not good.

The present disclosure provides an image forming apparatus including the manual feed tray having good convenience.

SUMMARY

The image forming apparatus of the present disclosure includes a side panel and a manual feed tray that is rotatable and installed on the side panel. The side panel includes an opening portion through which a sheet placed on the manual feed tray passes when the sheet is fed into the image forming apparatus. The manual feed tray includes an end cursor that is movable, and a guide portion that guides movement of the end cursor in a direction perpendicular to a rotational center of the manual feed tray. The opening portion is sized to accommodate the end cursor. When the opening/closing angle of the manual feed tray with respect to a horizontal direction exceeds a predetermined angle, the end cursor moves along the guide portion by gravity to a position where the end cursor can be accommodated in the opening portion.

DETAILED DESCRIPTION

Hereinafter, embodiments of the present disclosure will be described with reference to the figures.

Figure 1:
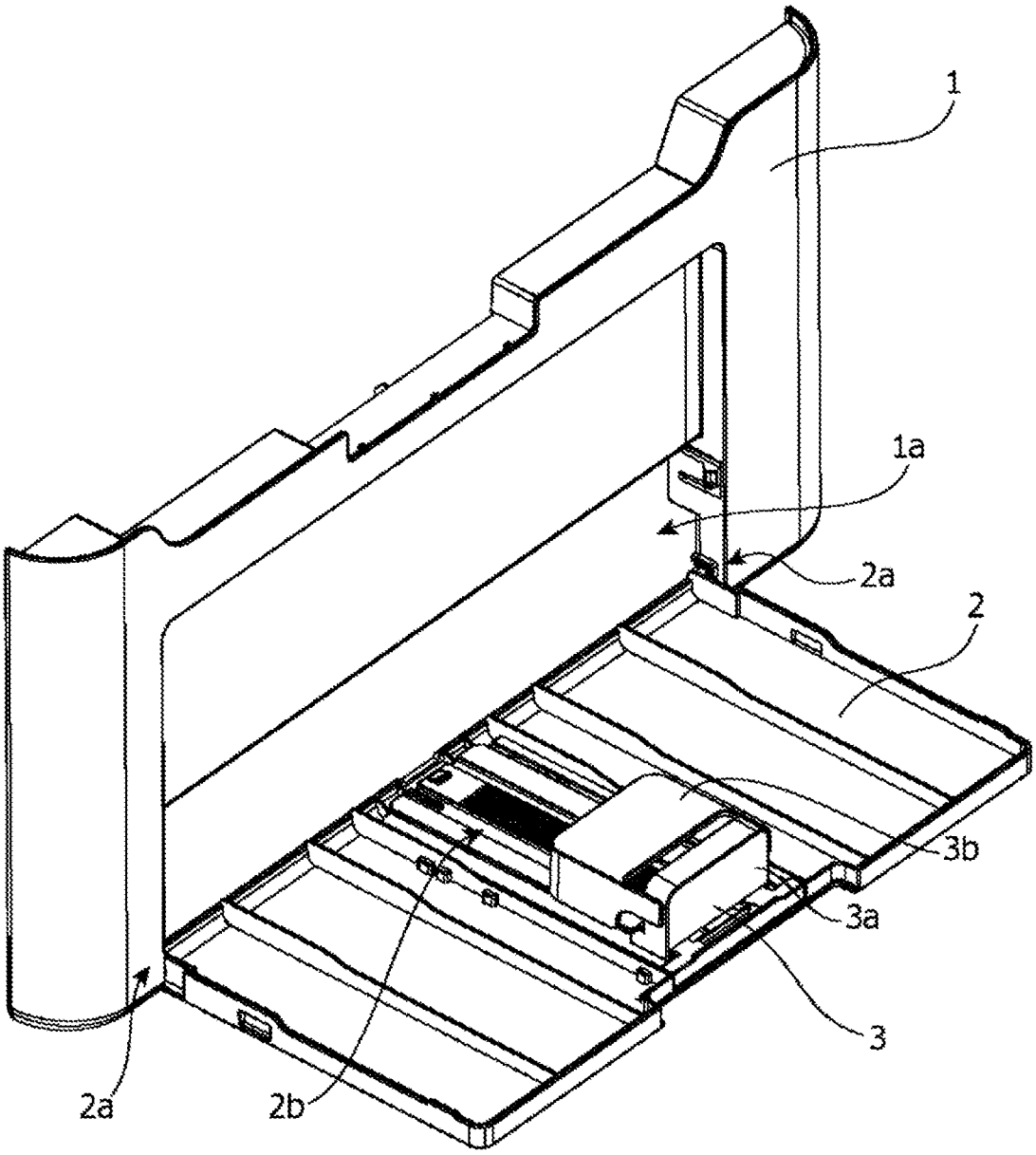
FIG. 1 is a perspective view showing an example of the side panel 1 and the manual feed tray 2 in the image forming apparatus according to the embodiment of the present disclosure.

FIG. 1 is a perspective view showing an example of the side panel 1 and the manual feed tray 2 in the image forming apparatus according to the embodiment of the present disclosure. The image forming apparatus is an apparatus such as a printer, a multi-function machine, etc. The side panel 1 constitutes a part of the housing of the image forming apparatus (a part substantially perpendicular to the bottom surface such as a front surface part, a back surface part, or a lateral side surface part).

The manual feed tray 2 is a rotatable plate-like member installed on the side panel 1. Specifically, the manual feed tray 2 is installed on the side panel 1 so as to be rotatable around a connecting portion 2*a* serving as a rotating shaft at an end portion on the bottom side of the side panel 1.

In this image forming apparatus, a sheet (print paper or the like) placed on the manual feed tray 2 is fed and conveyed into the image forming apparatus, and an image is printed on the sheet and discharged.

The side panel 1 is formed with the opening portion 1*a* having a substantially rectangular shape along a rotational axis. The sheet placed on the manual feed tray 2 passes through the opening portion 1*a* when being fed into the image forming apparatus.

The opening portion 1*a* has a size capable of accommodating an end cursor 3 to be described later. Specifically, the height (width in the height direction) of the opening portion 1*a* is larger than the width of the end cursor 3 (sheet contact member 3*b* to be described later) in the direction perpendicular to the rotational center of the manual feed tray 2 (that is, in the sheet feeding direction). However, the height of the opening portion 1*a* is smaller than the distance from the accommodation position of the end cursor 3 to the position of the end cursor 3 arranged corresponding to the rear end of the sheet.

The manual feed tray 2 includes the end cursor 3 capable of moving and a guide portion 2*b* for guiding the movement of the end cursor 3 in the direction perpendicular to the rotational center of the manual feed tray 2 (i.e. in the sheet feeding direction).

The end cursor 3 is a member that contacts the rear end of the sheet placed on the manual feed tray 2 so as to stably hold the sheet on the manual feed tray 2. The end cursor 3 includes the sliding member 3*a* which can slide while being in contact with the guide portion 2*b*, and the sheet contact member 3*b* that is foldable. When the rotation angle of the manual feed tray 2 reaches a predetermined angle to be described later, the sheet contact member 3*b* may be automatically folded by gravity.

When the opening/closing angle (rotation angle from the open state) of the manual feed tray 2 with respect to the horizontal direction exceeds a predetermined angle, the end cursor 3 automatically moves along the guide portion 2*b* by gravity to a position where the end cursor 3 can be accommodated in the opening portion 1*a* (hereinafter referred to as an accommodation position). The predetermined angle is, for example, an angle in a range of 30 degrees to 45 degrees.

Movement of the sliding member 3*a* in a direction perpendicular to the surface of the manual feed tray 2 is restricted by a connecting portion (not shown) of the sliding member 3*a* and the guide portion 2*b* so that the sliding member 3*a* does not come off from the guide portion 2*b*.

Figure 2:
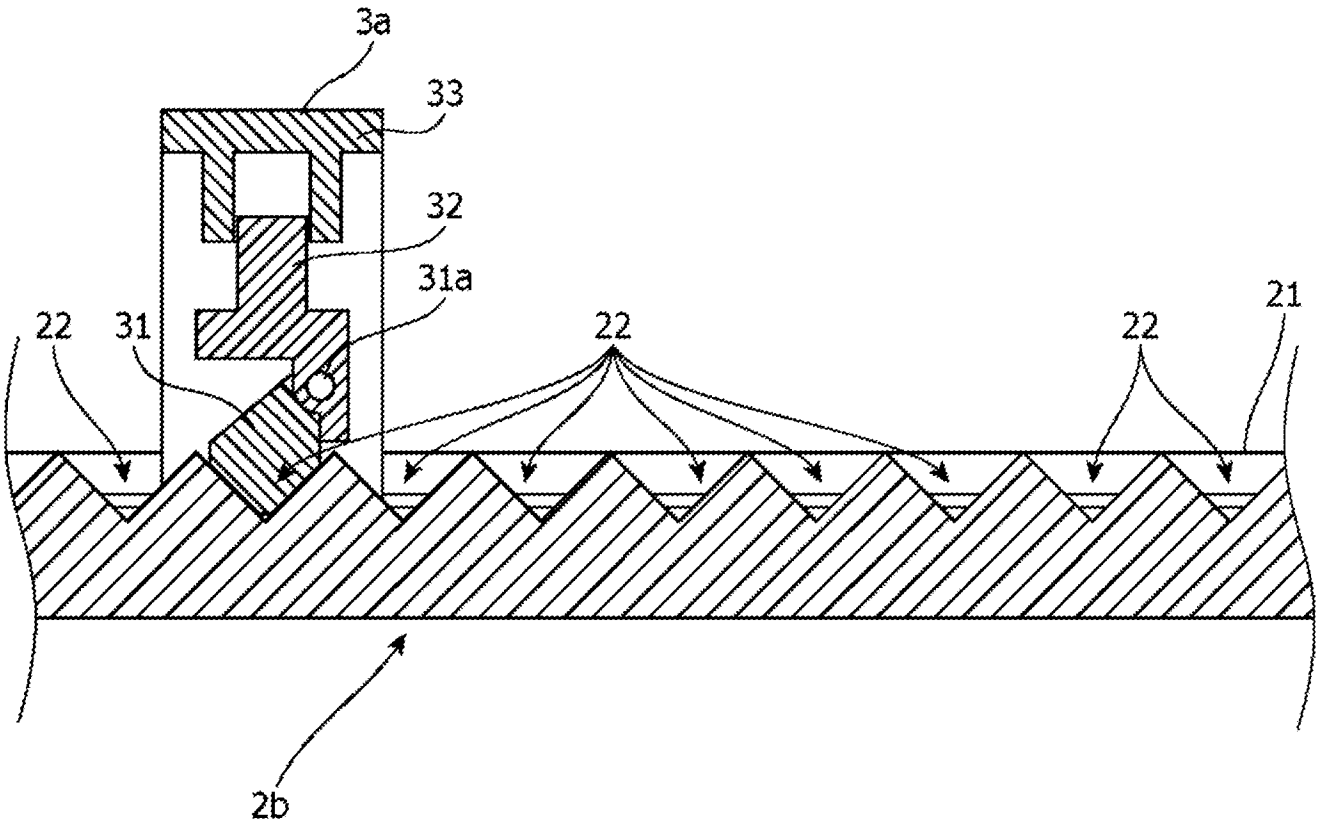
FIG. 2 is a cross-sectional view showing the guide portion 2*b* and the sliding member 3*a* of the end cursor 3 in FIG. 1.
Figure 3:
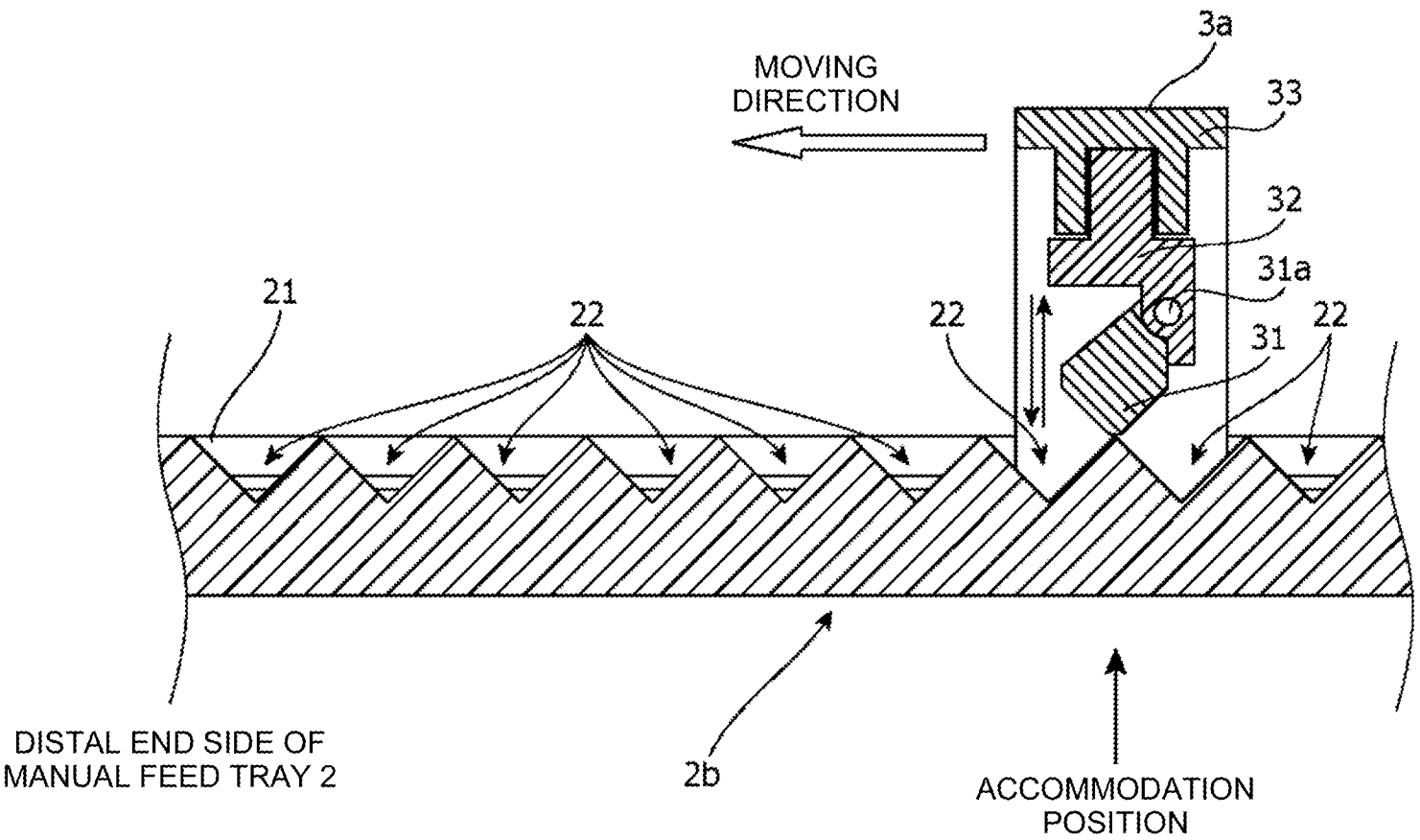
FIG. 3 is a cross-sectional view for explaining the operation of the sliding member 3*a* of the end cursor 3 when the user moves the end cursor 3 while the manual feed tray 2 in FIG. 1 is in the open state.
Figure 4:
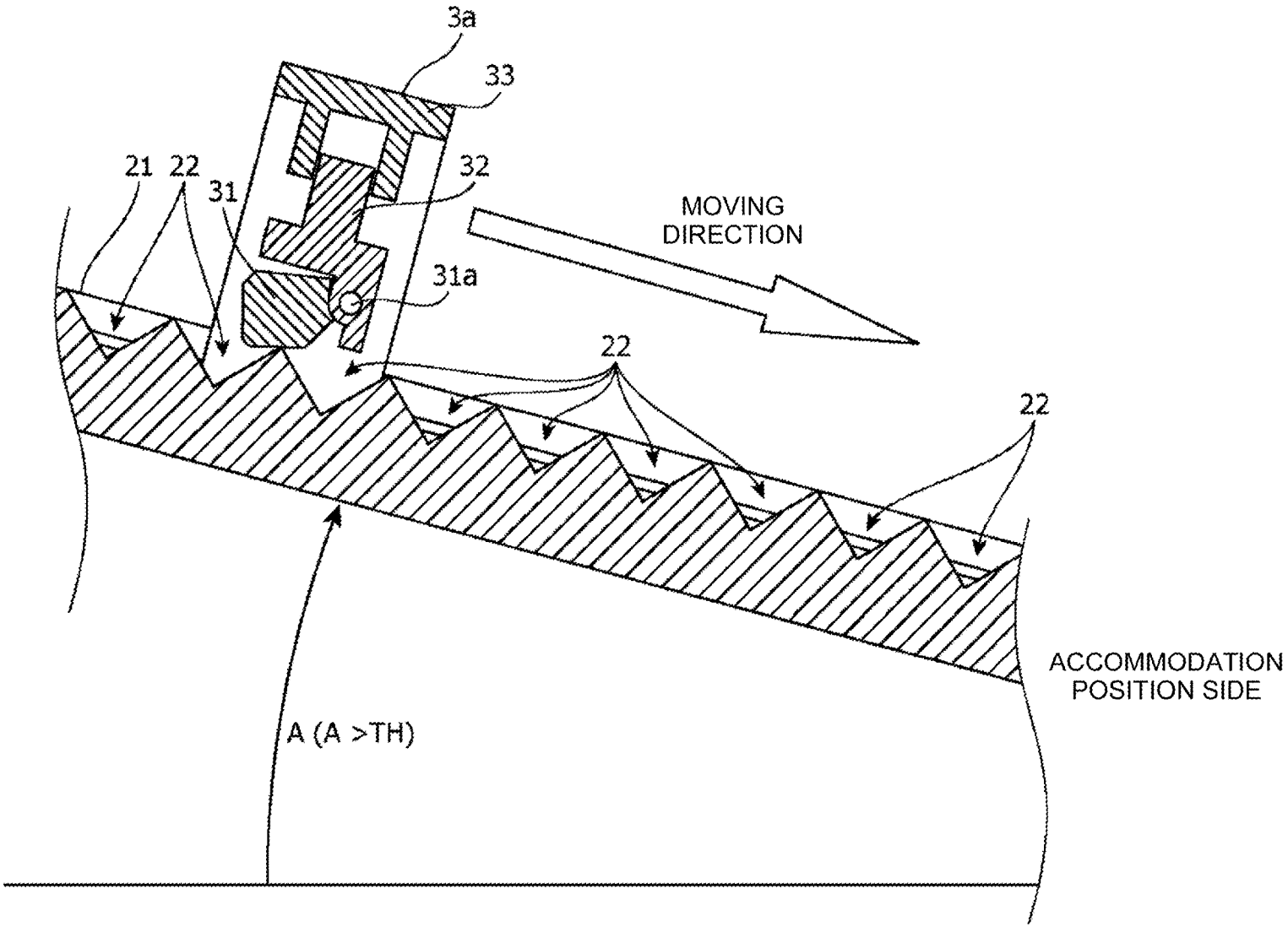
FIG. 4 is a cross-sectional view for explaining the operation of the sliding member 3*a* of the end cursor 3 when the manual feed tray 2 in FIG. 1 is rotated by the user and the end cursor 3 is automatically moved.

FIG. 2 is a cross-sectional view showing the guide portion 2*b* and the sliding member 3*a* of the end cursor 3 in FIG. 1. FIG. 3 is a cross-sectional view for explaining the operation of the sliding member 3*a* of the end cursor 3 when the user moves the end cursor 3 while the manual feed tray 2 in FIG. 1 is in the open state. FIG. 4 is a sectional view for explaining the operation of the sliding member 3*a* of the end cursor 3 in the case where the manual feed tray 2 in FIG. 1 is rotated by the user and the end cursor 3 is automatically moved.

For example as shown in FIG. 2, the guide portion 2*b* includes a guide rail 21 and a plurality of recesses 22 for positioning the end cursor 3, which are formed integrally with the main body of the manual feed tray 2 on the surface of the manual feed tray 2.

The end cursor 3 includes the flap member 31 capable of rotating around a rotating shaft, a driven member capable of supporting the rotating shaft 31*a* and moving in a direction perpendicular to the moving direction of the end cursor 3, and the support member 33 for supporting the driven member while restricting the movement of the driven member 32 other than in the direction perpendicular to the moving direction of the end cursor 3.

In this embodiment, for example as shown in FIG. 2, the plurality of recesses 22 are triangular columnar grooves each having a substantially triangular cross-section. For example as shown in FIG. 2, when the end cursor 3 is positioned, the flap member 31 is in surface contact with two wall surfaces of the plurality of recesses 22 which are two sides of the substantially triangular shape.

For example as shown in FIG. 3, when the user moves the end cursor 3 from the accommodation position to the distal end side of the manual feed tray 2 when the manual feed tray 2 is in the open state, the flap member 31 is prevented from rotating by the driven member 32, the flap member 31 and the driven member 32 are moved upward, and the distal end of the flap member 31 is separated from the plurality of recesses 22.

Therefore, when the user pulls out the end cursor 3 as shown in FIG. 3, for example, since the flap member 31 sequentially contacts the plurality of recesses 22 while moving up and down, a click sound and a click feeling are obtained, and the position of the end cursor 3 can be easily determined.

Further, for example as shown in FIG. 4, when the manual feed tray 2 is rotated by the user, the rotation angle A exceeds the predetermined threshold value TH, and the end cursor 3 automatically moves, the flap member 31 is rotated to release the surface contact with the two wall surfaces of the plurality of recesses 22.

In this manner, when the user closes the manual feed tray 2, the user rotates the manual feed tray 2 to generate a component force of gravity in the direction of the accommodation position, the flap member 31 is rotated to release the surface contact with the two wall surfaces of the plurality of recesses 22, and the end cursor 3 is automatically moved while sliding toward the accommodation position. In other words, in this case, the flap member 31 is rotated so that the end cursor 3 can be moved by sliding movement with a smaller force than when the end cursor 3 is pulled out.

Next, the operation of the image forming apparatus will be described.

(a) When the manual feed tray 2 is changed from the closed state (accommodated state) to the open state (using state)

When the user changes the manual feed tray 2 from the closed state (accommodated state) to the open state (using state), the manual feed tray 2 is rotated from the side panel 1 to be in the open state as shown in FIG. 1, for example. At this time, the end cursor 3 is in the accommodation position on the manual feed tray 2, and the sheet contact member 3*b* is folded.

Next, the user pulls out the end cursor 3 to a desired position (a desired rear end position of the sheet), and sets up the sheet contact member 3*b*. At this time, as described above, in the end cursor 3, for example as shown in FIG. 3, the flap member 31 and the driven member 32 of the sliding member 3*a* move up and down, the flap member 31 repeatedly contacts the plurality of recesses 22 of the guide portion 2*b*, and when the end cursor 3 is arranged at a desired position, the flap member 31 of the sliding member 3*a* of the end cursor 3 contacts and is locked to the two wall surfaces of the plurality of recesses 22, as shown in FIG. 2, for example.

Thereafter, the user places the sheet on the manual feed tray 2 with the trailing end thereof aligned with the end cursor 3, and then operates the image forming apparatus to cause the image forming apparatus to perform printing process or the like. In the printing process, the sheet is fed and conveyed into the apparatus by a sheet feeding roller (not shown) included in the opening portion 1*a*, and an image designated by the user is printed on the sheet.

(b) When the manual feed tray 2 is changed from the open state (using state) to the closed state (accommodated state)

The user causes the image forming apparatus to perform a printing process using the manual feed tray 2, and then rotates the manual feed tray 2 to accommodate the manual feed tray 2 in the side panel 1. At this time, the user rotates the manual feed tray 2 without manually moving the end cursor 3 to the accommodation position.

Figure 5:
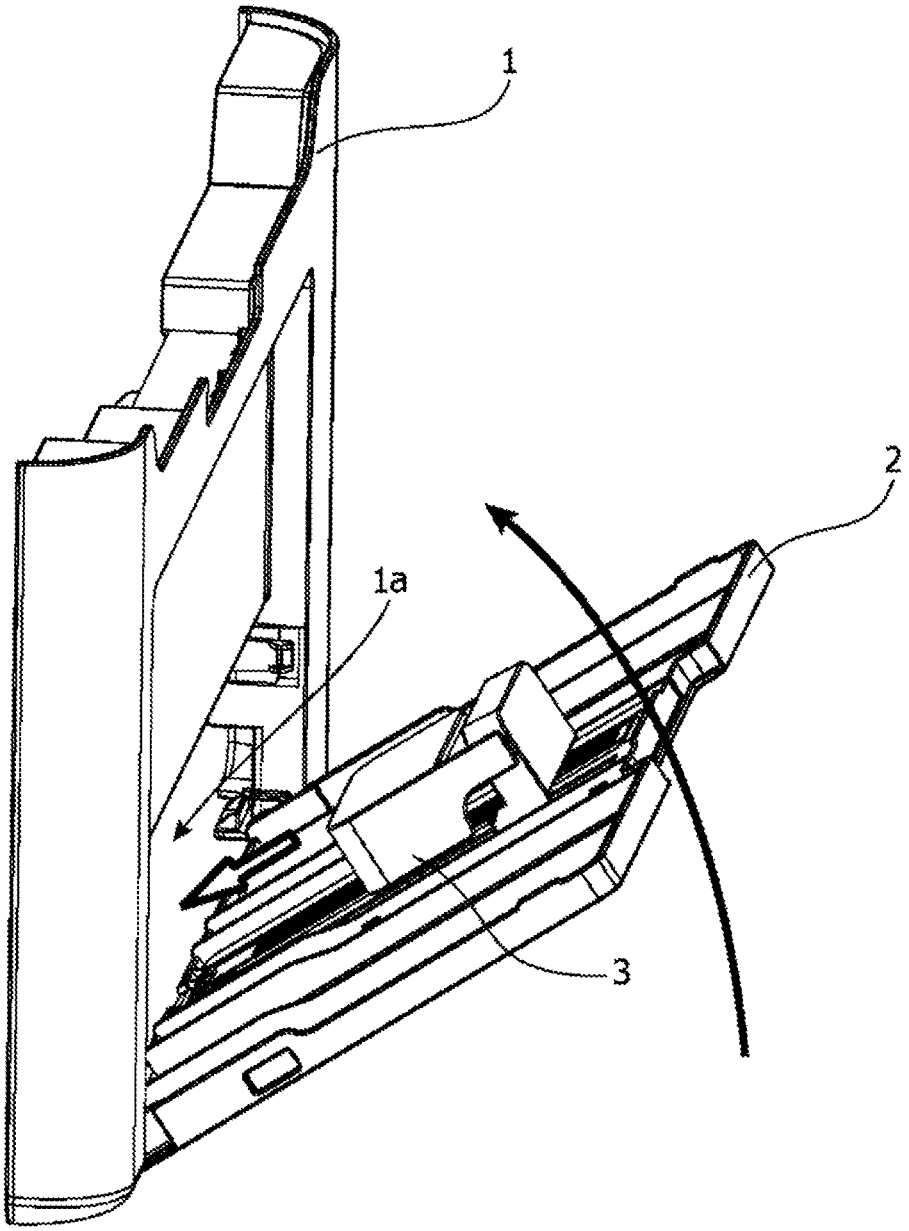
FIG. 5 is a perspective view for explaining the end cursor 3 during the rotation of the manual feed tray 2 in FIG. 1.
Figure 6:
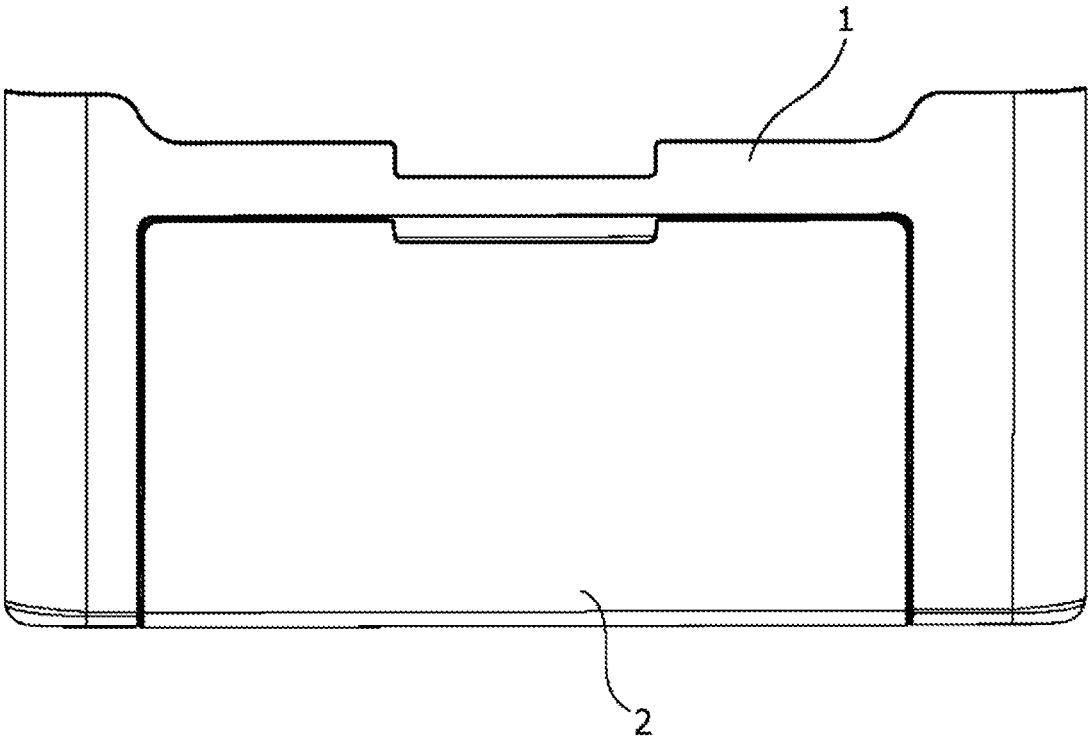
FIG. 6 is a view for explaining a state in which the manual feed tray 2 in FIG. 1 is accommodated in the side panel 1.

FIG. 5 is a perspective view for explaining the end cursor 3 during the rotation of the manual feed tray 2 in FIG. 1. FIG. 6 is a view for explaining a state in which the manual feed tray 2 in FIG. 1 is accommodated in the side panel 1.

At the start of rotation, the end cursor 3 is arranged corresponding to the rear end of the sheet. At this time, either all the sheets are used or the remaining sheets are removed, so that no sheets exist on the manual feed tray 2. When the rotation angle exceeds the predetermined threshold value, the sheet contact member 3*b* falls down in the end cursor 3, and the flap member 31 of the sliding member 3*a* rotates, so that the end cursor 3 automatically moves along the guide portion 2*b* toward the accommodation position by gravity, for example as shown in FIGS. 4 and 5, without hardly causing the flap member 31 and the driven member 32 to move up or down. Then, when the end cursor 3 reaches the accommodation position (end of the guide portion 2*b*) and stops, and the manual feed tray 2 is rotated by approximately 90 degrees, for example as shown in FIG. 6, the manual feed tray 2 is accommodated in the side panel 1, and the surface of the side panel 1 and the surface of the manual feed tray 2 are located on approximately the same plane.

According to the above-described embodiment, the side panel 1 includes a rotatable manual feed tray 2. The side panel 1 includes the opening portion 1*a* through which the sheet placed on the manual feed tray 2 passes when being fed into the image forming apparatus. The manual feed tray includes the movable end cursor 3 and the guide portion 2*b* for guiding the movement of the end cursor 3 in the direction perpendicular to the rotational center of the manual feed tray 2. Then, the opening portion 1*a* has a size capable of accommodating the end cursor 3, and when the opening/closing angle A of the manual feed tray 2 with respect to the horizontal direction exceeds the predetermined angle TH, the end cursor 3 moves along the guide portion 2*b* by gravity to the position capable of accommodating the end cursor 3 in the opening portion 1*a*.

As a result, the user operation for returning the end cursor 3 to the accommodation position is not required, and the manual feed tray 2 can be accommodated in the side panel 1 by only the user operation for rotating the manual feed tray 2, thereby improving the convenience of the manual feed tray 2.

According to the present disclosure, the image forming apparatus including a manual feed tray having good convenience can be obtained.

Various changes and modifications to the above-described embodiments will be apparent to those skilled in the art. Such changes and modifications may be made without departing from the spirit and scope of the subject matter and without diminishing the intended advantages. That is, such changes and modifications are intended to fall within the scope of the claims.

What is claimed is:

1. An image forming apparatus comprising:

a side panel; and a manual feed tray that is rotatable and installed on the side panel, the side panel including:

an opening portion through which a sheet placed on the manual feed tray passes when the sheet is fed into the image forming apparatus, the manual feed tray including:

an end cursor that is movable; and a guide portion that guides movement of the end cursor in a direction perpendicular to a rotational center of the manual feed tray, wherein the opening portion is sized to accommodate the end cursor; and when an opening/closing angle of the manual feed tray with respect to a horizontal direction exceeds a predetermined angle, the end cursor moves along the guide portion by gravity to a position where the end cursor can be accommodated in the opening portion, wherein the guide portion includes a plurality of recesses that position the end cursor, and the end cursor includes a flap member that is rotatable around a rotating shaft, and a driven member that supports the rotating shaft and is movable in a direction perpendicular to a moving direction of the end cursor, and wherein the plurality of recesses include a substantially triangular cross-section, when the end cursor is positioned, the flap member is in a surface contact with two wall surfaces of the plurality of recesses which are two sides of the substantially triangular shape, and when the opening/closing angle of the manual feed tray with respect to the horizontal direction exceeds a predetermined angle thereby moving the end cursor, the flap member is rotated to release the surface contact with the two wall surfaces of the plurality of recesses.

* * * * *